United States Patent [19]

Ness

[11] 4,137,105

[45] Jan. 30, 1979

[54] METHOD OF FORMING TOOLING FOR SUPERPLASTIC METAL SHEET

[75] Inventor: Martin E. Ness, Weston, Conn.

[73] Assignee: Gulf & Western Industries, Inc., New York, N.Y.

[21] Appl. No.: 807,924

[22] Filed: Jun. 20, 1977

[51] Int. Cl.[2] ..... C22F 1/18

[52] U.S. Cl. ..... 148/11.5 R

[58] Field of Search ..... 148/11.5 R

[56] References Cited

U.S. PATENT DOCUMENTS

| | | | |
|---|---|---|---|
| 3,420,717 | 1/1969 | Fields, Jr. et al. | 148/11.5 R |
| 3,578,511 | 5/1971 | Mehl et al. | 148/11.5 R |
| 3,595,060 | 7/1971 | Hundy | 148/11.5 R |
| 4,040,286 | 8/1977 | Abramowitz | 148/11.5 R |

*Primary Examiner*—W. Stallard

*Attorney, Agent, or Firm*—Meyer, Tilberry & Body

[57] ABSTRACT

There is provided a method of making a compression die set of the type including front and back die pieces for compressively forming a sheet of soft, pliable metal, such as superplastic metal, therebetween with one of the die pieces including surface impressions. This method includes the steps of providing a mass of metal in a superplastic state, placing a sheet of the soft, pliable metal corresponding to the sheet to be formed over the one die piece to cover the surface impressions, heating the mass of superplastic metal to an elevated forming temperature, and forcing the mass toward the sheet and the one die piece until the sheet flows completely into the surface impressions.

24 Claims, 8 Drawing Figures

METHOD OF FORMING TOOLING FOR SUPERPLASTIC METAL SHEET

This invention relates to the art of making tools for soft, thin metal sheet material and, more particularly, to a method of forming tooling for superplastic metal sheet.

This invention is particularly applicable for forming the back die piece used in compression forming of superplastic metal sheets to capture surface details and it will be described with particular reference thereto; however, the invention has broader applications and may be used for forming a back die piece used in compression forming soft, thin sheets of metal other than superplastic metal.

BACKGROUND OF INVENTION

For a number of years, it has been known that certain metals can be heat treated or otherwise processed to provide a material which has a flow stress which is dependent upon the strain rate during a forming operation. When this relationship is quite pronounced, the material has been known as superplastic metal, since it can be formed in a manner similar to molten glass or plastic. After being formed, the superplastic metal can be heat treated to produce a stronger metal part or component. As is well known in the superplastic art, such heat treatment improves the creep resistance and the tensile strength; however, in many applications the additional step in heat treatment is not required. The metal will hold its formed shape sufficiently for some uses. For background of certain features found in superplastic metal, U.S. Pat. No. 3,340,101 and U.S. Pat. No. 3,420,717 are incorporated by reference herein.

Various alloys can be transformed into a superplastic state for ease in forming. This metal can be elongated many times without necking and can flow into intricate shape when formed at an elevated temperature and at a relatively slow flow or strain rate. After forming, added strength may be obtained, if needed, by heat treating the formed metal. The most prevalent of these metals now in use is the known eutectoid alloy of zinc and aluminum. This alloy includes approximately 78% zinc and 22% aluminum. Other metals, in minor proportions, can be added to obtain certain improved or different properties. The eutectoid aluminum-zinc alloy is generally known in the trade by several trademarks and somewhat generically as Zn22Al. The present invention relates to the use of this particular material; however, other materials being capable of transformation into a superplastic state could be used in accordance with the invention. All of these metals have certain known properties used in defining superplastic metals. Also, certain soft, pliable metals such as soft copper, soft copper alloy, tin and silver can be processed in accordance with the present invention, as will become apparent in the description of the invention.

The present invention relates to the particular art of producing tooling of the compression type wherein two platens carrying die pieces are forced together to form a sheet of soft, pliable metal into the desired shape having surface impressions defined by the surface impressions of one or more of the die pieces. In this particular art, it is often desirable to cause a deep pattern when the metal being formed is relatively thin. Such applications involve simulated engraved patterns and surface contours which are found in many decorative items such as dishes now generally formed from silver plated brass and similar metals. In this art, it is common commercial practice to use a matched set of front and back dies to impress the embossed pattern and contours onto the metal being pressed between the die pieces. The front die piece is produced into the mirror image of the desired surface design. The back die piece or the die for the back side of the sheet workpiece is produced as close as possible to the final configuration of the compressed part. To produce sharp crisp detail in high relief situations, the back die or die piece must be manually fitted to the front die to achieve sufficient and uniform reproduction of the details on the sheet being compression formed. If this matching is not done accurately, the sheet may rupture during forming or it may not assume the exact detail of the embossed design of the front die piece, especially when the embossed design is deep compared to the thickness of the formed sheet. This manual production of the back die piece to be used in conjunction with a front die piece having the particular embossed design, is quite expensive and therefore adds significantly to the cost of the finished parts being formed between the two dies. This renders some applications of this particular tooling procedure uneconomical. The metal being formed in this particular type of tooling is generally a metal whose flow stress is generally independent of the strain rate, i.e. having a strain rate sensitivity below about 0.2. In other words, such metal is not superplastic. To overcome some of the difficulties experienced in making embossed items from flat metal sheets, superplastic metal can be used in its superplastic state. The parts can be heat treated, if required, by heating on the tooling or externally to provide better creep and strength properties. When a superplastic metal sheet is being employed for making embossed items, the tooling necessary for the forming operation can be reduced in cost by an amount which makes the tooling acceptable for various embossed items. In making relatively thick parts from superplastic metal sheets, while in a superplastic state, the depth of the embossing is relatively small compared to the final metal thickness of the item being formed; therefore, it is not necessary to provide matched tooling as used in forming embossed items and other metals. For instance, a machined front die part can be used with a generally flat or gradually curved rear or back die part. The superplastic metal is then compressed between the die parts or die pieces and embossing or surface impressions on one die piece is impressed upon one surface of the item being formed. This has proven successful when relatively thick items are being produced as the surface impressions are relatively well reproduced in the finished item. However, when the superplastic metal being formed is relatively thin sheet material, the use of a relatively flat or gradually contoured back die piece is not successful. Such uses distort the surface impressions, produce substantially varying thicknesses over the item being formed and form incomplete impressions of the desired surface embossing. Thus, when thin sheets of superplastic metal are being compression molded, it is still necessary to produce matching die pieces which require the hand machining previously described. Because of the finer details obtainable by superplastic metal sheet material when compressed between two die pieces, more accurate matched tooling is often needed when thin sheets of superplastic metal is being formed. Thus, the prime economical advantage of superplastic metals, which is low tooling costs, is not realized when thin superplastic metal sheet is being embossed with high resolution surface impressions by compression molding. When any soft, pliable metal in thin sheet form, such as silver, annealed copper, annealed copper alloys and tin, are being used to produce an item having detailed surface impressions or designs, it has heretofore been considered necessary to use independently matched and/or machined die pieces. This is quite expensive, involves long tooling lead time and requires highly skilled tool and die craftsmen.

The present invention relates to an improvement in tooling wherein the advantages of superplastic metal is realized even when the item being compression molded is relatively thin, without requiring matching die pieces in the tooling system.

STATEMENT OF INVENTION

In accordance with the present invention there is provided a method of making a back die piece for use in a system for compression molding of thin superplastic metal sheets, or sheets formed of other soft, pliable material, of the type having a given sheet thickness between first and second surfaces, the system uses a front die piece of metal having a general contour with surface impressions thereon. This method comprises the steps of providing a mass of metal conditioned to be in a superplastic state at an elevated forming temperature, heating the mass to an elevated forming temperature, placing one of the sheets over the front die piece and forcing the mass toward the sheet and front die piece until the sheet flows completely into the surface impressions.

By using this method, the back die piece is automatically formed into a contour which matches the desired contour required during subsequent forming operations. The back die piece can be heat treated by heating it above its eutectoid transformation temperature and then cooling it at a low cooling rate. Thereafter, as long as the die is not heated above the eutectoid transformation temperature of the back die piece, it will retain the initially formed shape for subsequent compression molding operations. This type of back die piece conforms with the desired configuration necessary to provide complete and clear impressions on the sheet being formed. After repeated operations, any wear in the back die piece could be corrected, in some instances, by again transforming the back die piece to a superplastic condition through heating the back die piece to a temperature above its eutectoid transformation temperature and quenching the same to produce the fine grain superplastic condition or state. Under normal circumstances, the back die piece is so inexpensive and rapidly producible that a new, replacement die piece is manufactured.

The primary object of the present invention is the provision of a method of making tooling for compression molding of thin sheets of soft, pliable metal, such as superplastic metal, between two die pieces, which method makes it economical to produce high resolution surface impressions or embossings in thin superplastic metal items.

Another object of the present invention is the provision of a method of making tooling for compression molding of soft, pliable, thin metal sheets, such as superplastic metal sheets, by two die pieces, which method produces matched die pieces without requiring machining of both die pieces.

Still a further object of the present invention is the provision of a method as defined above, which method reduces the cost of producing matched die pieces.

Yet another object of the present invention is the provision of a method as defined above, which method produces accurately dimensioned matched die pieces.

A further object of the present invention is the provision of a method as defined above, which method uses a superplastic metal for one of the two matched die pieces.

These and other objects and advantages will become apparent from the following description, taken together with the accompanying drawings.

BRIEF DESCRIPTION OF THE DRAWINGS

In this specification, the drawings include the following views.

SUPERPLASTIC METAL

Figure 1:
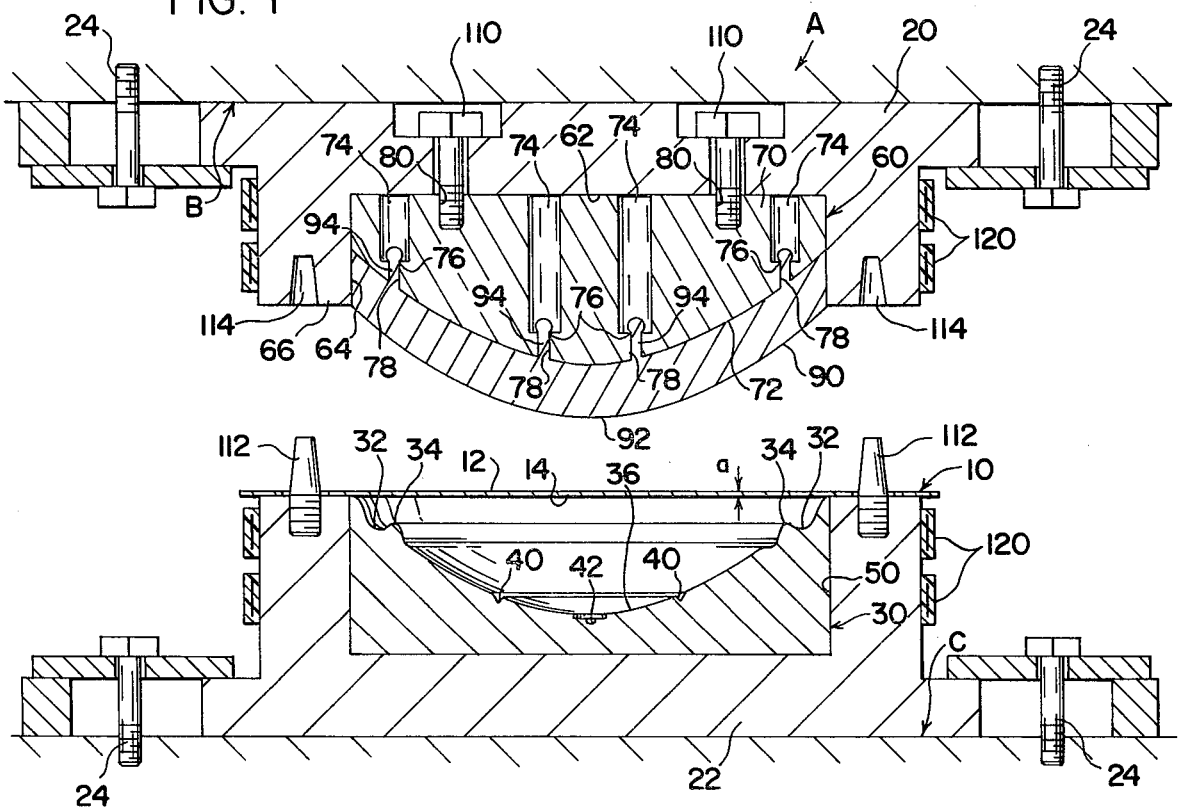
FIG. 1 is a schematic, side elevational, cross-sectional view showing, somewhat schematically, two spaced members of a compression molding device preparatory to forming the back die piece.

In the preferred embodiment of the invention, the particular superplastic metal used is Zn22Al sold by The New Jersey Zinc Company of Bethlehem, Pennsylvania under the trademark "SUPER-Z". Of course other alloys having a superplastic state could be used. The Zn22Al alloy has an eutectoid transformation temperature of approximately 527° F. As is well known in the art, this eutectoid transformation temperature may vary a few degrees for different reasons, such as the addition of other alloying metals. This preferred alloy is generally formed when in the superplastic state, i.e. when heated to an elevated forming temperature. The elevated processing or forming temperature is in the general range of 480° F.–520° F., which is just below the eutectoid transformation temperature. The transformation of the alloy to a superplastic state can be done by a variety of procedures, the most common of which involve heating the Zn22Al alloy to 580° F.–700° F., preferably about 600° F., and then quenching the material in water or another quenching media. After the metal has been formed at a temperature of 480° F.–520° F., the material may be heated to about 600° F. and cooled at a lower cooling rate, such as less than about 30° F. per minute. This slow cooling can be in a furnace which has a cooling rate of about 1° F. per minute or in air which air cooling produces a rate of approximately 30° F. per minute. During slow cooling the grains grow and the material exhibits somewhat improved creep and strength properties. The formed metal may be polished, plated or otherwise finished in a manner similar to zinc die castings. Such metal can be compression molded under pressures in the general range of 100 psi–20,000 psi. The speed of forming under a selected pressure can produce a strain rate of about $10^{-4}$—500 inches/inch-/minute. The Zn22Al alloy exhibits the superplastic condition or state only when it is heated to an elevated forming temperature, known to be generally 480° F.–520° F. A metal in a superplastic state is distinguished from other metals by its high sensitivity of flow stress to the strain rate. This sensitivity has the imperical relationship shown in FIG. 6 and is designated by the exponential m. To show examples of this sensitivity, heated steel has a sensitivity of about 0.002–0.08, and heated platinum has a sensitivity of about 0.03–0.15. Superplastic metals when heated to an elevated forming temperature have a sensitivity of greater than about 0.3 and Zn22Al has a sensitivity of 0.4–0.6 according to the elevated forming temperature. Consequently, a superplastic metal is a metal which is formulated and treated to have a high dependence between flow stress and strain rate when heated to an elevated forming temperature. Consequently, the heated metal may be made to flow and form with pressures as low as about 100–1,000 psi. As another feature, superplastic metal may be heat treated to produce better creep and strength properties, if these are required. When in the superplastic state, a metal has a low memory and elasticity and is formed similar to molten glass or thermal plastic materials. When superplastic metal is used herein, it refers to metals having these known physical properties.

PREFERRED EMBODIMENT

Figure 2:
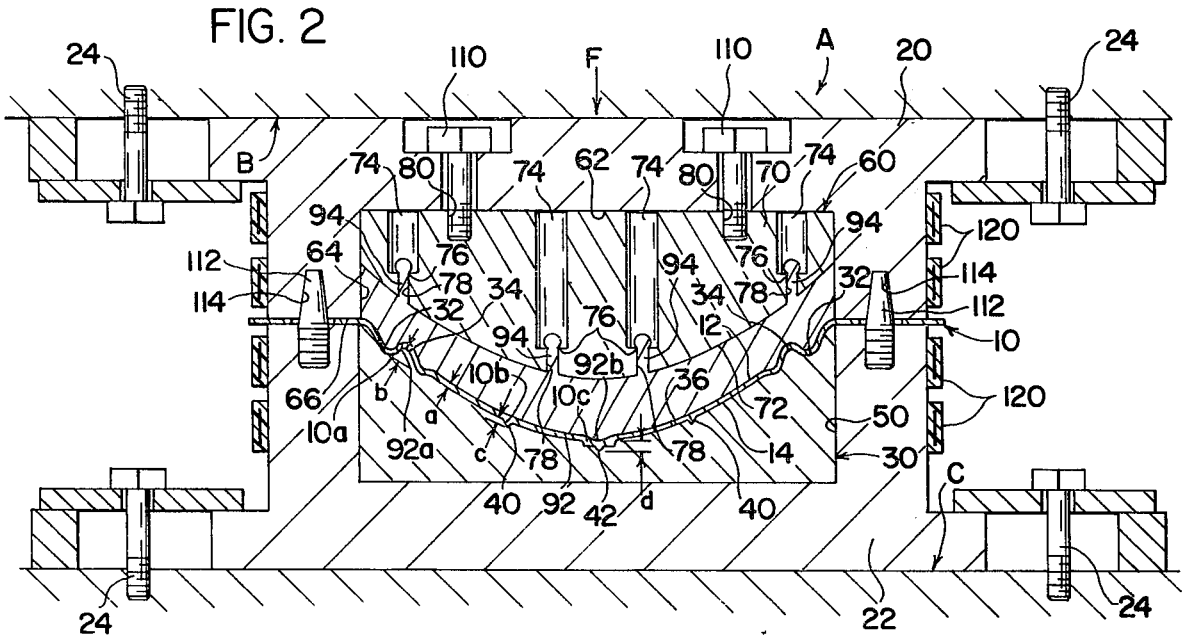
FIG. 2 is a view similar to FIG. 1 showing the back die piece in its initially formed condition.

Referring now to the drawings, wherein the showings are for the purpose of illustrating the preferred embodiment of the invention only, and not for the purpose of limiting same, FIGS. 1 and 2 show an impression molding device A including an upper platen B and a lower platen C which are moved together during a compression molding operation in a direction indicated by arrow F. The movement can be accomplished by an appropriate molding device, such as a hydraulic power press. Device A is used to compress mold or form a thin sheet 10 formed from a soft, pilable metal, such as metal conditioned to have a superplastic state when heated to an elevated forming temperature. The superplastic metal sheet has generally flat surfaces 12, 14 prior to molding. A thin sheet indicates a sheet which has a thickness which is relatively small compared to the amount of surface distortion during the molding process. As a general rule, sheet 10 has a thickness less than about 0.400 inches. As a more generic definition a thin sheet is a sheet which requires discrete surface distortion at one surface when forming a die piece defined, detail or shape at the opposite surface.

In accordance with the illustrated embodiment, compression molding device A includes an upper die shoe 20 attached to platen B and a lower die shoe 22 attached to lower platen C by a plurality of bolts 24. To form the desired design, shape and embossed condition on surface 14, there is provided a front die piece 30 with an outer surface 36 having various surface impressions representatively shown as ripples 32, 34, groove 40 and embossing recess 42. The front die piece is secured, by an appropriate means, in a recess 50 formed in lower die shoe 22.

Rear die piece 60, which includes back die face support 70 and back die face 90, is located in a recess 62 having a wall 64 terminating in a generally planar surface 66. This recess can have any desired shape; however, a cylindrical shape is used in the illustrated embodiment. Within recess 62 there is provided back die face support 70 having a front surface 72 generally matching the contour of surface 36 of front die piece 30. Vertical bores 74 terminate in openings 76 defined by ports 78. Threaded bores 80 are used to secure rear die piece 60, including the back die face support 70, onto upper die shoe 20. Back die face 90 is formed from a metal which is conditioned to have a superplastic state when at an elevated forming temperature and includes an outer surface 92 and connecting post 94 extending through ports 78 and openings 76 to secure die face 90 onto the back die face support. In practice, back die 90 is formed from Zn22Al conditioned by heat treating to have a superplastic state when heated to an elevated forming temperature in the range of 480° F. to 520° F.

Figure 4:
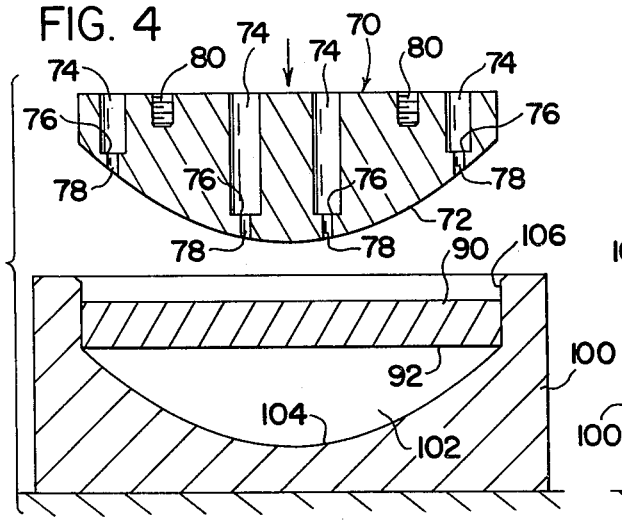
FIGS. 4 and 5 are schematic, cross-sectional views illustrating certain processing steps used to produce a blank of superplastic metal for the back or rear die piece as illustrated in FIGS. 1 and 2.
Figure 5:
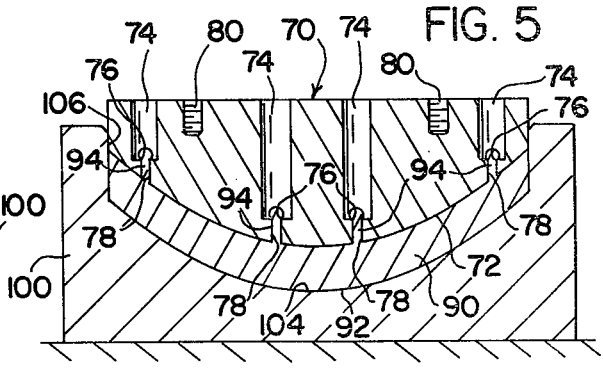

Referring now to FIGS. 4 and 5, a schematic representation of a method for performing back die face 90 is illustrated. In this illustration, a holder or forming device 100 has a recess 102 with the bottom wall 104 generally matching surface 36. A cylindrical wall 106 is used to form the back die face and for sizing a blank to fit into recess 62. A properly cut blank of superplastic metal, such as superplastic zinc, is placed into recess 102, as shown in FIG. 4. Thereafter, the back die face support 70 is forced downwardly into recess 102. This contours the blank of superplastic metal into the form shown in FIG. 5 with part of the metal extruding through ports 78 and forming securing knobs in bores 74. During this preliminary forming process, the metal of the blank to be formed is heated to an appropriate forming temperature which is, in the preferred embodiment, in the range of 480° F.–520° F. It is possible to heat holder 100 to the desired temperature and allow heat energy to be conducted into the superplastic metal. In addition, back die face support 70 is also heated to the desired temperature so that during the forming operation, the superplastic metal of the blank is at the elevated forming temperature. Thereafter, support 70 is removed from holder 100 and assembled into recess 62 of upper die shoe 20, as shown in FIG. 1. At this time, the outer surface 92 of back die face 90 has a contour generally matching the desired contour of surface 36 of hardened front die piece 30. This lower die piece is machined with the necessary contour and is generally hardened and polished to provide the desired surface impressions or embossings. These are all designated generically as "surface impressions". Bolts 110 are used to secure rear or back die piece 60 in place, as shown in FIG. 1. Post 112 and recesses 114 in upper die shoe 20 and lower die shoe 22 are used to guide the die shoes in their vertical movement in the direction indicated by arrow F in FIG. 2.

The sheet 10 of superplastic metal having the properties of the sheet to be formed is then positioned over one die piece 30, as shown in FIG. 1. Upper platen B is then moved downwardly into a position shown in FIG. 2 in the same manner as desired in subsequent compression molding processes. In this down position, the metal forming sheet 10 is pressed into and molded into the various surface indentations or impressions of surface 36. The upper platen is forced downwardly with a pressure sufficient for the metal of sheet 10 to fill all surface impressions and exert pressure thereon. At the same time, back die face 90 is formed to produce a matching contour in surface 92 of back die face 90 formed from a similar superplastic metal. In practice, the superplastic metal of sheet 10 and back die face 90 are the same; however, they may be different alloys. In the preferred embodiment, the alloy of sheet 10 when forming the back die face is the same as the alloys to be formed in device A. During this initial pressing operation, the metal of sheet 10 and back die face 90 is heated to an elevated forming temperature in the general range of 480° F.–520° F. This can be done by electrical heating rods 120 or by any other arrangement for maintaining the elevated forming temperature of the various superplastic metals in the structure so far defined. Sheet 10 can be heated before placed over front die piece 30. In practice, the sheet is heated to the elevated forming temperature by conduction from back die face 90. After the initial operation, ripples 10*a*, rib 10*d* and raised embossed area 10*c* of sheet 10 are formed, as illustrated in FIG. 2. At the same time, the outer surface 92 of back die face 90 is provided with rippled portion 92*a* and slight indentation 92*b* above the embossed recess 42. Thus, the outer surface 92 is formed during the forming operation to provide a matching back die face having matching contours defined only by the necessary flow of material required by sheet 10 to fill the indentations and contours of surface 36. Thus, during the forming operation of the rear die face 90, the superplastic metal forming both the die face and the superplastic sheet of the type to be subsequently compression molded, act as a unit and are formed together. The parting line between these two superplastic metal elements is determined by the flow and pressure requirements needed to accurately press the superplastic metal into the various indentations and impressions machined into surface 36. Thereafter, the platens are separated and surface 92 retains the necessary surface contour to form a matching rear die face for the desired shape to be imparted to a surface 14 of sheet 10 during subsequent pressure molding operations. Wall 64 prevents outward extrusion of the superplastic metal forming back die face 90. Thus, during the closing operation the superplastic metal, in a superplastic state, is retained within the upper and lower recesses 62, 50 respectively, and flows only in the necessary direction to provide an upper matching die surface.

After the forming step shown in FIG. 2, in practice, rear or back die piece 60 is removed and the metal forming back die face 90 is heated on the die piece to a temperature above the eutectoid transformation temperature of approximately 527° F. In practice, the material is heated to a temperature in the general range of 600° F.–660° F. and then cooled at a slow rate. The slow rate can be obtained by cooling the metal forming back die face 90 in a furnace at approximately 1° F. per minute or in air at a rate of approximately 30° F. per minute. In either instance, the slow cooling rate improves the creep and strength of the metal of back die face 90. The alloy is relatively hard and can be subsequently used as a rear matching die member for device A, as shown in FIGS. 1 and 2.

Figure 2A:
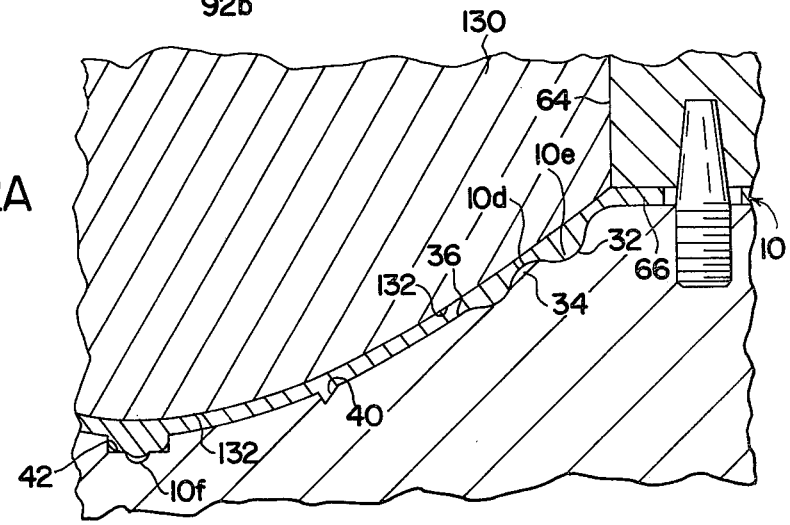
FIG. 2A is an enlarged, partial view showing certain features of FIGS. 1 and 2 using another type of back or rear die piece.

During the forming operation, the metal of the back die face 90 and sheet 10 act together. In FIG. 2, thickness a is the thickness of strip 10 which has not been modified substantially between the non-formed condition and the formed condition. Ripple 32, 34 has a height b extending outwardly from surface 36. In a like manner, indentation or groove 40 in surface 36 has an extended height c. The height d of embossing recess 42 is also illustrated in FIG. 2. Some of these extended heights are relatively large compared to the thickness a of sheet 10. When this occurs, there is a need to provide a contoured rear die face so that the metal of the strip will flow into and assume the details of these various impressions on surface 36. If the extended height with respect to a general contour of surface 36 is greater than approximately 25% of sheet thickness a, the present invention is quite successful. If only a small material displacement were required in the forming operation, as compared to the thickness of the sheet being formed, a generally flat back surface could be used. In that instance, no appreciable deflection at the rear of the sheet will be required during flow of the superplastic metal into the surface modifications. The advantages of this invention are somewhat schematically illustrated in FIG. 2A. In this Figure, a hardened back die face 130 is employed with a fixed surface 132 matching the general contour of surface 36. When using a fixed back surface, the small displacement of metal into groove 40 does not require flow of metal adjacent the rear surface of strip 10. Consequently, the fixed surface 132 may be appropriate. However, in the area of ripples 32, 34, a fixed surface causes a thin section 10*d* and a thick section 10*e*. This is undesirable in most molded items. In addition, with generally flat fixed surface 132, there is a possibility of leaving an unfilled portion 10*f* in embossing recess 42, which is not filled by the deformed sheet 10. In order to completely fill embossing recess 42, extreme pressure must be used which can cause other difficulties in the pressing operation. Indeed, even with strong pressure exerted on the material, the possibility of this pressure being directed through the metal into the bottom of recess 42 is somewhat doubtful. for this reason, crisp sharp details are not obtained with the fixed, non-matching type of backing die piece, as illustrated in FIG. 2A.

Figure 3:
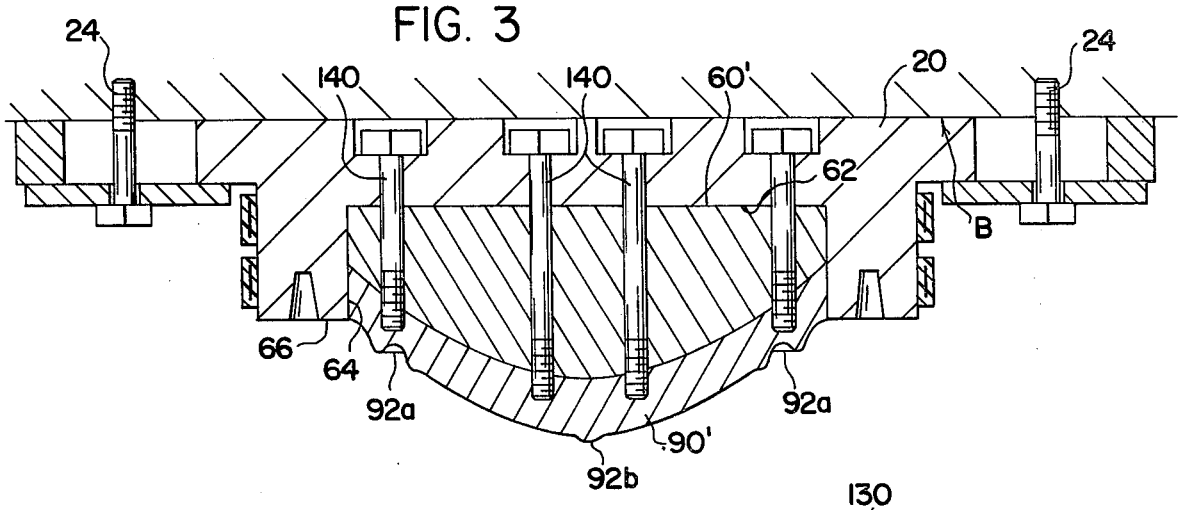
FIG. 3 is a view showing a back or rear die piece constructed in accordance with the present invention and having certain modifications.

Referring now to FIG. 3, a slight modification of the preferred embodiment of the invention is illustrated. In this modification, the arrangement for holding the back die face 90 onto upper die shoe 20 is modified. In this second arrangement, the rear die piece 60' is located in recess 62 and is held in this position by a plurality of bolts 140 threadably secured in the superplastic metal forming back die face 90'. In all other respects, the modification shown in FIG. 3 is the same as the preferred embodiment illustrated in FIGS. 1 and 2. The same process and principles are used in forming the back die face 90'.

Figure 6:
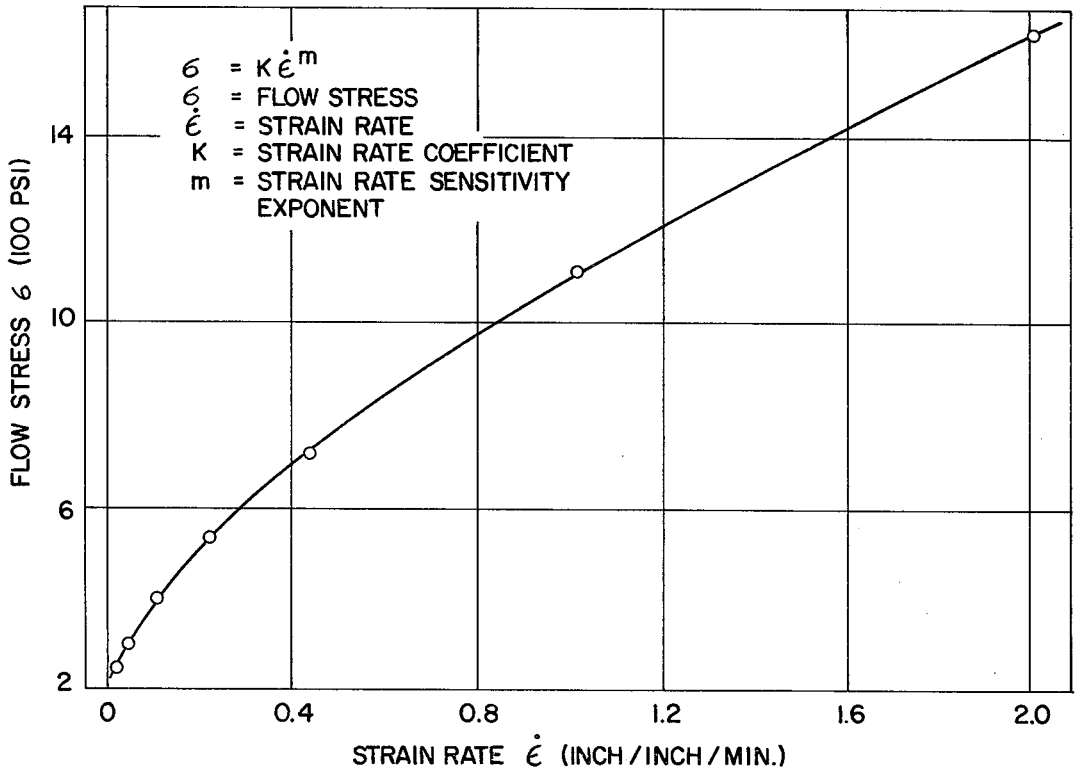
FIG. 6 is a graph illustrating physical properties of a particular superplastic metal employed in the present invention; and, FIG. 7 is a graph illustrating a further physical property of a superplastic metal as used in the preferred embodiment of the invention.
Figure 7:
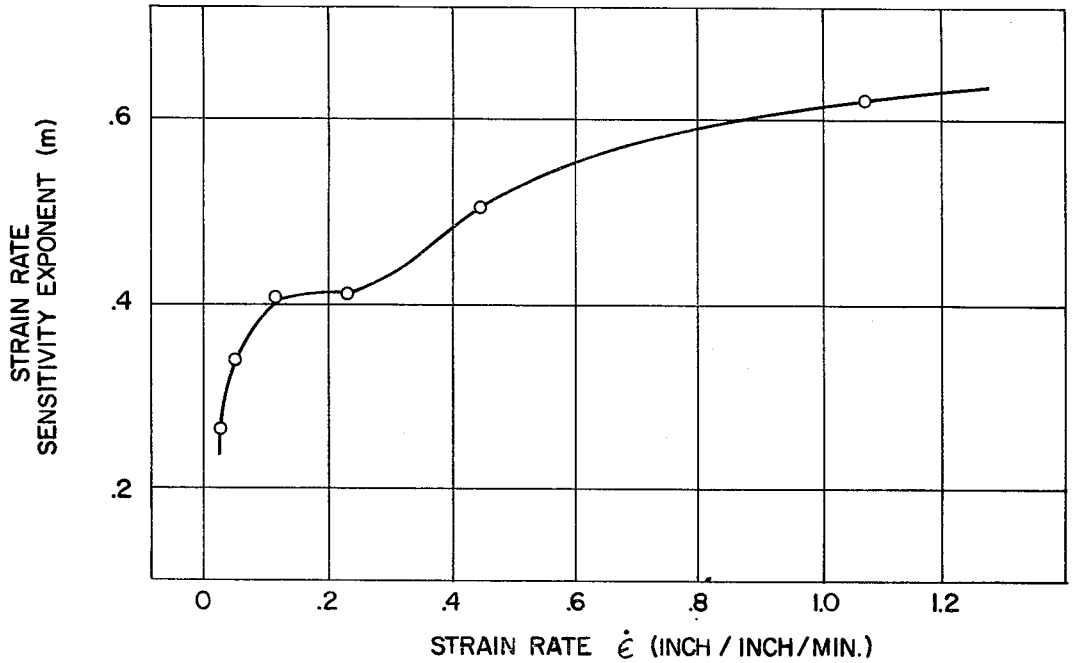

Referring now to FIG. 6, this is a graph illustrating the dependency of the flow stress on the strain rate in a somewhat well known superplastic material (Zn22Al), when it is in a superplastic state. The formula and legend found in the upper left hand portion of this graph is the imperical relationship between the flow stress and strain rate. The strain rate exponent m is the strain rate sensitivity which was discussed in the introductory portion of this specification and is used in the art to define a superplastic metal. FIG. 7 shows another graph indicating that the strain rate sensitivity m is dependent upon the strain rate in Zn22Al. In addition, this sensitivity is also dependent upon temperature and increases as temperature increases. FIGS. 6 and 7 show typical properties of superplastic metals when in the superplastic state. For that reason, superplastic metals are generally formed at a temperature only slightly below the eutectoid transformation temperature of the particular metal. In the alloy forming the basis of the graph in FIG. 7, the strain rate between approximately 0.2 and 1.2 inches/inch/minutes, is approximately 0.4–0.6. In practice, the sensitivity of superplastic metal used for the back die face and/or for sheet 10 is generally considered to be greater than approximately 0.30 for a strain rate of about 0.2–1.2 inches/inch/minute, and at an elevated forming temperature. Other metals can be used in sheet 10 with the superplastic back die face 90. The die face is formed in the same way and is then heat treated to transform it from a superplastic material to a generally normal zinc-aluminum alloy having strength and low creep to be used to compression form soft, pliable metal as a matching back die member.

Having thus defined the invention, it is claimed:

1. A method of forming a back die piece for use in a system for compression molding thin superplastic sheets of the type having a strain rate sensitivity of at least about 0.3 at an elevated forming temperature and a given thickness between first and second surfaces, said system using a front die piece of metal having a strain rate sensitivity of substantially less than 0.2 wherein said front die piece has a general contour and discrete surface impressions extending from said general contour, with said surface impressions having displacements from said general contour of at least about 25% of said sheet thickness and requiring, during compression of said sheet against said front die piece, a metal flow adjacent said second sheet surface, said metal flow being generally transverse to said general contour, said method comprising the steps of:

(a) providing a back die piece formed from a mass of superplastic metal having a strain rate sensitivity of at least about 0.3 at an elevated forming temperature;
(b) heating said back die piece to said elevated forming temperature;
(c) placing one of said sheets over said front die;
(d) forcing said back die piece toward said sheet and said front die piece until said sheet flows completely into said surface impressions; and,
(e) causing said sheet to be heated to an elevated temperature at least during said forcing step.

2. A method as defined in claim 1 wherein said superplastic mass of metal is a metal alloy including major portions of aluminum and zinc.

3. A method as defined in claim 2 wherein said alloy is approximately 78% zinc and 22% aluminum.

4. A method as defined in claim 1 wherein said strain rate sensitivity of said mass is in the general range of 0.3–0.6 at an elevated forming temperature.

5. A method as defined in claim 1 including the additional steps of:

(f) heating said back die piece to a processing temperature above the eutectoid transformation temperature of said mass; and,
(g) allowing said back die piece to cool at a low cooling rate.

6. A method as defined in claim 5 wherein said eutectoid transformation temperature is approximately 527° F.

7. A method as defined in claim 5 wherein said processing temperature is above about 580° F.

8. A method as defined in claim 5 wherein said processing temperature is in the general range of 580° F.–700° F.

9. A method as defined in claim 5 wherein said cooling rate is no greater than about 30° F. per minute.

10. A method as defined in claim 1 wherein said elevated forming temperature is in the general range of 480° F.–520° F.

11. A method as defined in claim 1 wherein said elevated forming temperature is in the general range of 500° F.–520° F.

12. A method as defined in claim 1 wherein said pressing step is at a pressure of at least about 1000 psi.

13. A method of forming a back die piece for use in a system for compression molding of thin superplastic metal sheets of the type having a given thickness between first and second surfaces, said system using a front die piece of metal having a general contour with surface impressions therein, said method comprising the steps of:

(a) providing a back die piece formed from a mass of metal conditioned to display a superplastic state when heated to an elevated forming temperature;
(b) heating said back die piece to said elevated forming temperature;
(c) placing one of said sheets over said front die piece;
(d) forcing said back die piece toward said sheet and said front die piece until said sheet flows completely into said surface impressions; and,
(e) causing said sheet to be heated to an elevated heating temperature at least during said forcing step.

14. A method as defined in claim 13 wherein said superplastic mass of metal is an alloy including major portions of aluminum and zinc.

15. A method as defined in claim 14 wherein said alloy is approximately 78% zinc and 22% aluminum.

16. A method as defined in claim 13 wherein said strain rate sensitivity of said mass is in the general range of 0.3–0.6 at an elevated forming temperature.

17. A method as defined in claim 13 wherein said eutectoid transformation temperature is approximately 527° F.

18. A method as defined in claim 13 wherein said elevated forming temperature is in the general range of 480° F.–520° F.

19. A method of making a compression die set of the type including front and back die pieces for compressively forming a sheet of superplastic metal therebetween with said front die pieces including surface impressions, said method comprising the steps of:

(a) providing a back die piece formed from a mass of metal conditioned to be in a superplastic state at an elevated froming temperature;
(b) placing a sheet of superplastic metal corresponding to the sheet to be formed over said front die pieces to cover said surface impressions;
(c) heating said back die piece of superplastic metal to said elevated forming temperature;
(d) forcing said back die piece toward said sheet and said front die piece until said sheet flows completely into said surface impressions; and,
(e) causing said sheet to be heated to an elevated forming temperature at least during said forcing step.

20. A method as defined in claim 19 wherein said heat causing step includes heating said sheet to an elevated forming temperature before placing said sheet over said front die piece.

21. A method as defined in claim 19 wherein said heat causing step includes heating said sheet to an elevated forming temperature after placing said sheet over said front die piece.

22. A method as defined in claim 21 wherein said heat causing step includes heating said sheet by said heated mass during said forcing step.

23. A method of making a compression die set of the type including front and back generally matching die pieces for compressively forming a sheet of soft, pliable metal therebetween with one of said die pieces including surface impressions, said method comprising the steps of:

(a) providing said other of said die pieces as a mass of metal conditioned to be in a superplastic state at an elevated forming temperature;

(b) placing a sheet of said soft, pliable metal corresponding to the sheet to be formed over said one of said die pieces to cover said surface impressions;

(c) heating said other die piece to said elevated forming temperature; and, (d) forcing said other die piece toward said sheet and said one die piece until said sheet flows completely into said surface impressions.

24. A method as defined in claim 23 wherein said soft, pliable metal is a metal selected from the group consisting of superplastic metal, soft copper, soft copper alloys, silver and tin.

* * * * *

UNITED STATES PATENT AND TRADEMARK OFFICE

CERTIFICATE OF CORRECTION

PATENT NO. : 4,137,105

DATED : January 30, 1979

INVENTOR(S) : Martin E. Ness

It is certified that error appears in the above-identified patent and that said Letters Patent are hereby corrected as shown below:

Column 1, line 29, "in" should read -- of --. Column 5, line 10, "imperical" should read -- empirical --; line 43, "pilable" should read -- pliable --. Column 6, line 12, "post" should read -- posts --; line 19, "performing" should read -- preforming --; line 51, "Post" should read -- Posts --. Column 7, line 15, "10d" should read -- 10b --. Column 8, line 32, "for" should read -- For --; line 53, "imperical" should read -- empirical --; line 68, "minutes" should read -- minute --. Column 10, line 46, "froming" should read -- forming --.

Signed and Sealed this

*Sixth* Day of *November 1979*

[SEAL]

*Attest:*

RUTH C. MASON
*Attesting Officer*

LUTRELLE F. PARKER
*Acting Commissioner of Patents and Trademarks*